US010386780B2

(12) United States Patent
Itabashi

(10) Patent No.: US 10,386,780 B2
(45) Date of Patent: Aug. 20, 2019

(54) IMAGE FORMING APPARATUS

(71) Applicant: Brother Kogyo Kabushiki Kaisha, Nagoya-shi, Aichi-ken (JP)

(72) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/140,631

(22) Filed: Sep. 25, 2018

(65) Prior Publication Data

US 2019/0179254 A1 Jun. 13, 2019

(30) Foreign Application Priority Data

Dec. 12, 2017 (JP) ..... 2017-237660
Sep. 3, 2018 (JP) ..... 2018-164668

(51) Int. Cl.
*F21S 8/00* (2006.01)
*G03G 21/16* (2006.01)
*G03G 21/18* (2006.01)
*F21Y 115/10* (2016.01)

(52) U.S. Cl.
CPC ..... *G03G 21/1633* (2013.01); *F21S 8/00* (2013.01); *G03G 21/1842* (2013.01); *F21Y 2115/10* (2016.08)

(58) Field of Classification Search
CPC ... G03G 21/1633; G03G 21/1842; F21S 8/00; F21Y 2115/10
See application file for complete search history.

(56) References Cited

U.S. PATENT DOCUMENTS 8,594,530 B2 11/2013 Sato et al.
2009/0142092 A1* 6/2009 Sato ..... G03G 21/1846 399/111
2012/0070189 A1* 3/2012 Okabe ..... G03G 21/1853 399/111
2012/0183320 A1 7/2012 Sato et al.
2014/0212170 A1* 7/2014 Kato ..... G03G 21/1666 399/118

FOREIGN PATENT DOCUMENTS

JP 2012-144019 A 8/2012

* cited by examiner

*Primary Examiner* — Gregory H Curran
(74) *Attorney, Agent, or Firm* — Banner & Witcoff, Ltd.

(57) ABSTRACT

In a state where a first drum cartridge is mounted on a drawer unit located at an external position, a first exposure head moves from a first position through a second position to a third position. The first position is a position where the first exposure head is adjacent to a first photosensitive drum and a first drum cartridge is prevented from being removed from the drawer unit. The second position is a position where the first exposure head is farther away from the first photosensitive drum than at the first position and the first exposure head is slidably moved from the first position. The third position is a position where the first exposure head is farther away from the first photosensitive drum than at the second position, the first exposure head is rotatably moved from the second position, and the first drum cartridge is allowed to be removed.

12 Claims, 10 Drawing Sheets

IMAGE FORMING APPARATUS

CROSS REFERENCE TO RELATED APPLICATIONS

This application claims priority from Japanese Patent Application Nos. 2017-237660 filed Dec. 12, 2017 and 2018-164668 filed Sep. 3, 2018. The entire content of each of the priority applications is incorporated herein by reference.

TECHNICAL FIELD

This disclosure relates to an image forming apparatus.

BACKGROUND

Conventionally, there is known an image forming apparatus that includes a drum cartridge and a drawer unit. The drum cartridge includes a photosensitive drum. The drawer unit is configured such that the drum cartridge is mounted thereon. The drawer unit includes an exposure head for exposing the photosensitive drum. The exposure head is configured to move between a first position at which the exposure head is adjacent to the photosensitive drum and a second position at which the exposure head is farther away from the photosensitive drum than at the first position.

SUMMARY

According to one aspect, this specification discloses an image forming apparatus. The image forming apparatus includes a main housing, a first drum cartridge, and a drawer unit. The first drum cartridge includes a first photosensitive drum. The drawer unit is configured such that the first drum cartridge is mounted thereon. The drawer unit is configured to move in a moving direction between an internal position at which the drawer unit is located inside the main housing and an external position at which the drawer unit is located outside the main housing. The drawer unit includes a drawer frame and a first exposure head supported by the drawer frame and configured to expose the first photosensitive drum. In a state where the first drum cartridge is mounted on the drawer unit located at the external position, the first exposure head is configured to move from a first position through a second position to a third position. The first position is a position at which the first exposure head is adjacent to the first photosensitive drum and the first drum cartridge is prevented from being removed from the drawer unit. The second position is a position at which the first exposure head is farther away from the first photosensitive drum than at the first position and the first exposure head is slidably moved from the first position. The third position is a position at which the first exposure head is farther away from the first photosensitive drum than at the second position, the first exposure head is rotatably moved from the second position, and the first drum cartridge is allowed to be removed from the drawer unit.

BRIEF DESCRIPTION OF THE DRAWINGS

Embodiments in accordance with this disclosure will be described in detail with reference to the following figures wherein.

DETAILED DESCRIPTION

In the image forming apparatus, it is conceived to increase movement distance of the exposure head from the first position to the second position in order to more reliably prevent the drum cartridge from contacting the exposure head when the drum cartridge is removed from the drawer unit.

However, when increasing the movement distance of the exposure head, the size of the drawer unit needs to be increased by that amount.

An example of an object of this disclosure is to provide an image forming apparatus that minimizes an increase in size of a drawer unit and prevent a first drum cartridge from contacting a first exposure head when the first drum cartridge is removed from the drawer unit.

1. Image Forming Apparatus

An image forming apparatus is described with reference to FIGS. 1 and 2.

Figure 1:
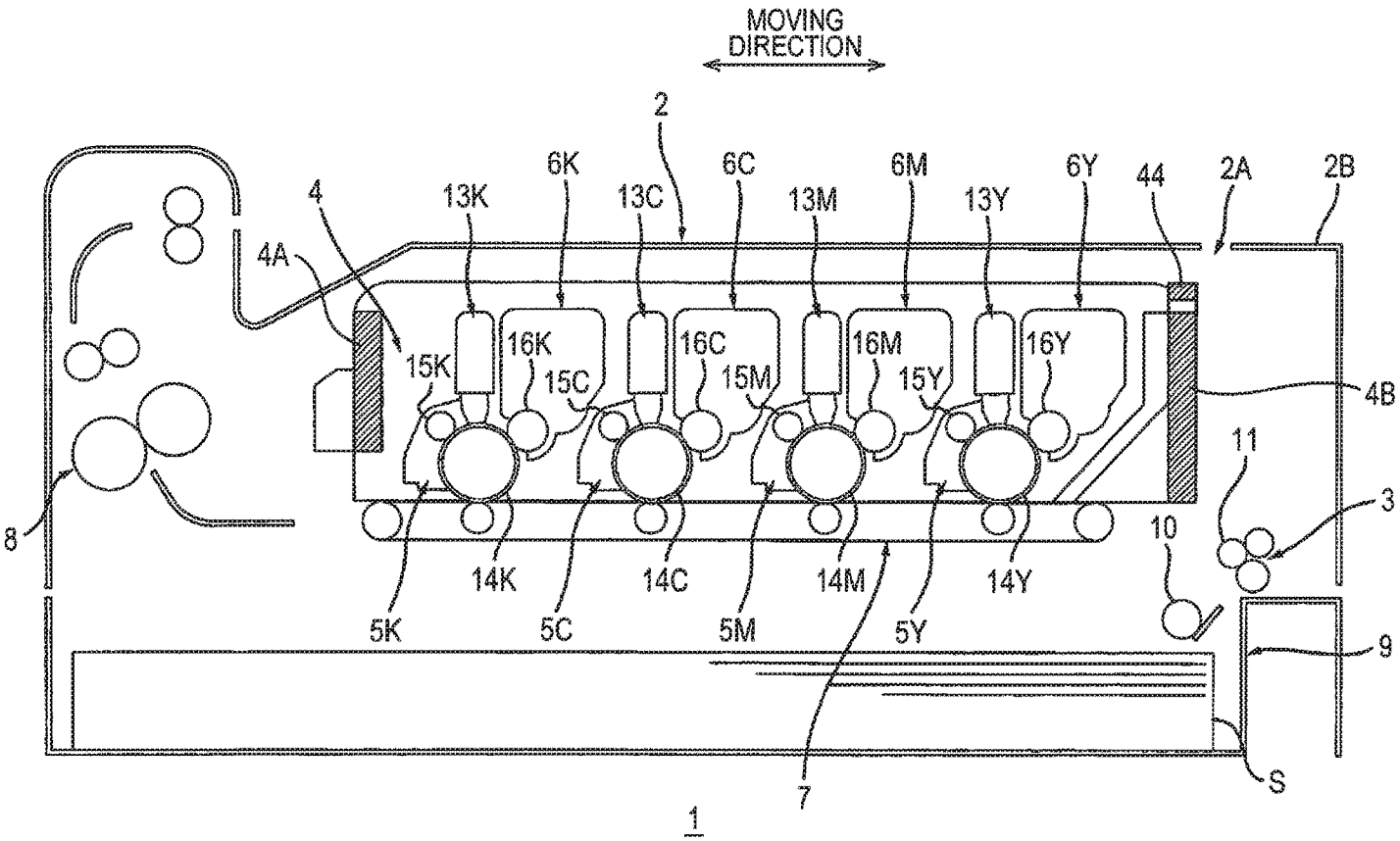
FIG. 1 is a schematic diagram of an image forming apparatus.

As shown in FIG. 1, an image forming apparatus 1 includes a main housing 2, a feeder 3, a drawer unit 4, a plurality of drum cartridges 5Y, 5M, 5C, 5K, a plurality of developing cartridges 6Y, 6M, 6C, 6K, a transfer unit 7 and a fixing device 8.

1.1 Main Housing

The main housing 2 forms an exterior of the image forming apparatus 1. The main housing 2 accommodates the feeder 3, the drawer unit 4, the plurality of drum cartridges 5Y, 5M, 5C, 5K, the plurality of developing cartridges 6Y, 6M, 6C, 6K, the transfer unit 7 and the fixing device 8. The main housing 2 has an opening 2A. The opening 2A is located at an opposite side from the fixing device 8 with respect to the drawer unit 4 in a state where the drawer unit 4 is located at an internal position. The internal position is described later. In addition, the main housing 2 includes a cover 2B. The cover 2B is configured to move between a closed position (see FIG. 1) at which the opening 2A is closed and an open position (see FIG. 2) at which the opening 2A is open.

1.2 Feeder

The feeder 3 is configured to supply a sheet S to a photosensitive drum 14Y. The sheet S is, for example, printing paper. The photosensitive drum 14Y is described later. The feeder 3 includes a sheet feed tray 9, a pick-up roller 10 and a sheet feed roller 11. The sheet feed tray 9 accommodates the sheet S. The pick-up roller 10 is configured to convey the sheet S that is inside the sheet feed tray 9 to the sheet feed roller 11. The sheet feed roller 11 is configured to convey the sheet S from the pick-up roller 10 to the photosensitive drum 14Y.

1.3 Drawer Unit

Figure 2:
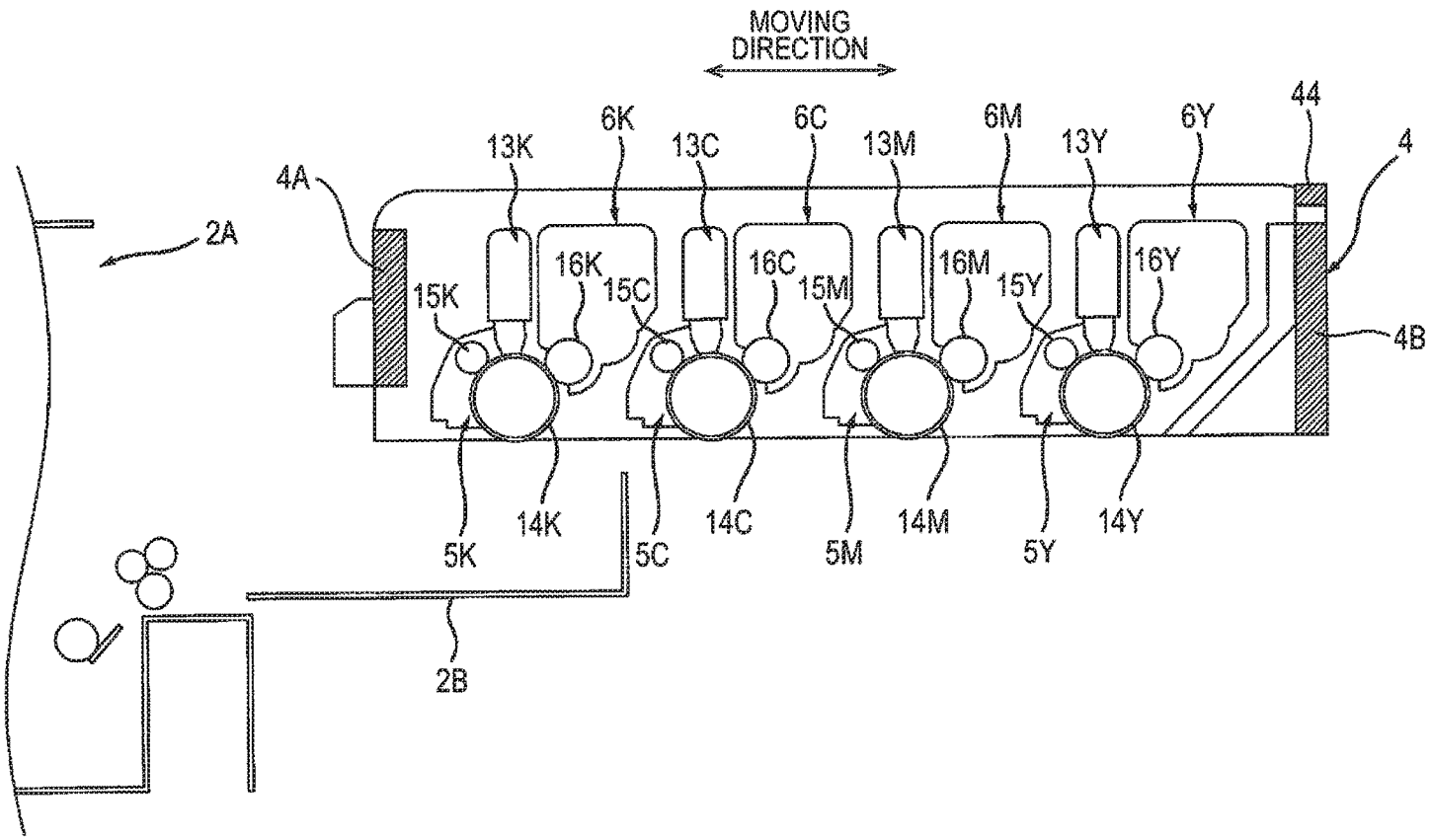
FIG. 2 is an illustration of a state in which a drawer unit shown in FIG. 1 is located at an external position.

As shown in FIG. 2, the drawer unit 4 moves between an internal position (see FIG. 1) and an external position (see FIG. 2) through the opening 2A when the cover 2B is at the open position. The internal position is a position of the drawer unit 4 when the drawer unit 4 is located inside the main housing 2. The external position is a position of the drawer unit 4 when the drawer unit 4 is located outside of the main housing 2. A direction in which the drawer unit 4 moves between the internal position and the external position is defined as a moving direction. As shown in FIG. 1, the drawer unit 4 includes a plurality of exposure heads 13Y, 13M, 13C, 13K.

The plurality of exposure heads 13Y, 13M, 13C, 13K forms a row along the moving direction with intervals between the exposure heads. The plurality of exposure heads 13Y, 13M, 13C, 13K is located above the plurality of photosensitive drums 14Y, 14M, 14C, 14K in a state where the plurality of drum cartridges 5Y, 5M, 5C, 5K is mounted on the drawer unit 4. The exposure head 13Y is configured to expose the photosensitive drum 14Y. The exposure head 13M is configured to expose the photosensitive drum 14M. The exposure head 13C is configured to expose the photosensitive drum 14C. The exposure head 13K is configured to expose the photosensitive drum 14K.

1.4 Plurality of Drum Cartridges

Each of the plurality of drum cartridges 5Y, 5M, 5C, 5K is configured to be mounted onto the drawer unit 4 when the drawer unit 4 is at the external position (see FIG. 2). In a state where the plurality of drum cartridges 5Y, 5M, 5C, 5K is mounted on the drawer unit 4, the plurality of drum cartridges 5Y, 5M, 5C, 5K forms a row along the mounting direction with intervals between the drum cartridges.

The drum cartridge 5Y includes a photosensitive drum 14Y, and a charger 15Y.

The photosensitive drum 14Y rotates about a particular rotational axis. A direction in which the rotational axis of the photosensitive drum 14Y extends is defined as an axial direction. The photosensitive drum 14Y extends in the axial direction. The photosensitive drum 14Y has a cylindrical shape.

The charger 15Y is configured to charge the surface of the photosensitive drum 14Y. The charger 15Y charges the surface of the photosensitive drum 14Y. Then, the exposure head 13Y exposes the surface of the charged photosensitive drum 14Y, to thereby form an electrostatic latent image on the surface of the photosensitive drum 14Y. The charger 15Y is located at an opposite side from a developing roller 16Y with respect to the exposure head 13Y in the moving direction in a state where the drum cartridge 5K is mounted on the drawer unit 4. The developing roller 16Y is described later. The charger 15Y is located at an upstream side of the exposure head 13Y in a direction of rotation of the photosensitive drum 14Y in a state where the drum cartridge 5Y is mounted on the drawer unit 4. More specifically, the charger 15Y is a charging roller. Note that the charger 15Y may be a scorotron charger.

Note that the drum cartridge 5M includes the photosensitive drum 14M and a charger 15M. The drum cartridge 5C includes the photosensitive drum 14C and a charger 15C. The drum cartridge 5K includes the photosensitive drum 14K and a charger 15K. The drum cartridges 5M, 5C, 5K all have the same structure as the drum cartridge 5Y and are described in the same way as the drum cartridge 5Y. Therefore, a description of the drum cartridges 5M, 5C, 5K is omitted.

1.5 Plurality of Developing Cartridges

The plurality of developing cartridges 6Y, 6M, 6C, 6K is configured to be mounted onto the drawer unit 4 when the drawer unit 4 is at the external position (see FIG. 2). When mounted onto the drawer unit 4, the plurality of developing cartridges 6Y, 6M, 6C, 6K forms a row in the moving direction with intervals between the developing cartridges.

The developing cartridge 6Y is configured to store toner that is supplied to the photosensitive drum 14Y. The developing cartridge 6Y includes the developing roller 16Y.

The developing roller 16Y is configured to supply toner stored in the developing cartridge 6Y to the photosensitive drum 14Y. An electrostatic latent image is developed by supplying the toner stored in the developing cartridge 6Y to the photosensitive drum 14Y on which the electrostatic latent image has been formed. With this, a toner image is formed on the surface of the photosensitive drum 14Y. In other words, the toner image is formed on the surface of the photosensitive drum 14Y by electrostatically moving the toner from the developing roller 16Y to the photosensitive drum 14Y and developing the electrostatic latent image that is formed on the photosensitive drum 14Y. A part of the developing roller 16Y is accommodated in the developing cartridge 6Y. The developing roller 16Y is located at a downstream side of the exposure head 13Y in the direction of rotation of the photosensitive drum 14Y in a state where the drum cartridge 5Y and the developing cartridge 6Y are mounted on the drawer unit 4. The developing roller 16Y contacts the surface of the photosensitive drum 14Y in a state where the drum cartridge 5Y and the developing cartridge 6Y are mounted on the drawer unit 4.

Note that the developing cartridge 6M is configured to store the toner that is supplied to the photosensitive drum 14M and includes the developing roller 16M. The developing cartridge 6C is configured to store the toner that is supplied to the photosensitive drum 14C and includes the developing roller 16C. The developing cartridge 6K is configured to store the toner that is supplied to the photosensitive drum 14K and includes the developing roller 16K. The developing cartridges 6M, 6C, 6K all have the same structure as the developing cartridge 6Y and are described in the same way as the developing cartridge 6Y. Therefore, a description of the developing cartridges 6M, 6C, 6K is omitted.

1.6 Transfer Unit

The transfer unit 7 is located below the plurality of photosensitive drums 14Y, 14M, 14C, 14K in a state where the plurality of drum cartridges 5Y, 5M, 5C, 5K is mounted on the drawer unit 4 and the drawer unit 4 is at the internal position. The transfer unit 7 contacts the plurality of photosensitive drums 14Y, 14M, 14C, 14K in a state where the plurality of drum cartridges 5Y, 5M, 5C, 5K is mounted on the drawer unit 4 and the drawer unit 4 is at the internal position. The transfer unit 7 conveys the sheet S that is supplied from the feeder 3 to the fixing device 8. The transfer unit 7 transfers toner images of each of the plurality of photosensitive drums 14Y, 14M, 14C, 14K onto the sheet S when the sheet S contacts each of the plurality of photosensitive drums 14Y, 14M, 14C, 14K.

1.7 Fixing Device

The fixing device 8 is configured to heat and apply pressure to the sheet S on which the toner image has been transferred to affix the toner image to the sheet S. The sheet S passes through the fixing device 8 and is discharged to a top surface of the main housing 2.

2. Details of Drawer Unit

The drawer unit 4 is described below with reference to FIGS. 3 to 10.

Figure 3:
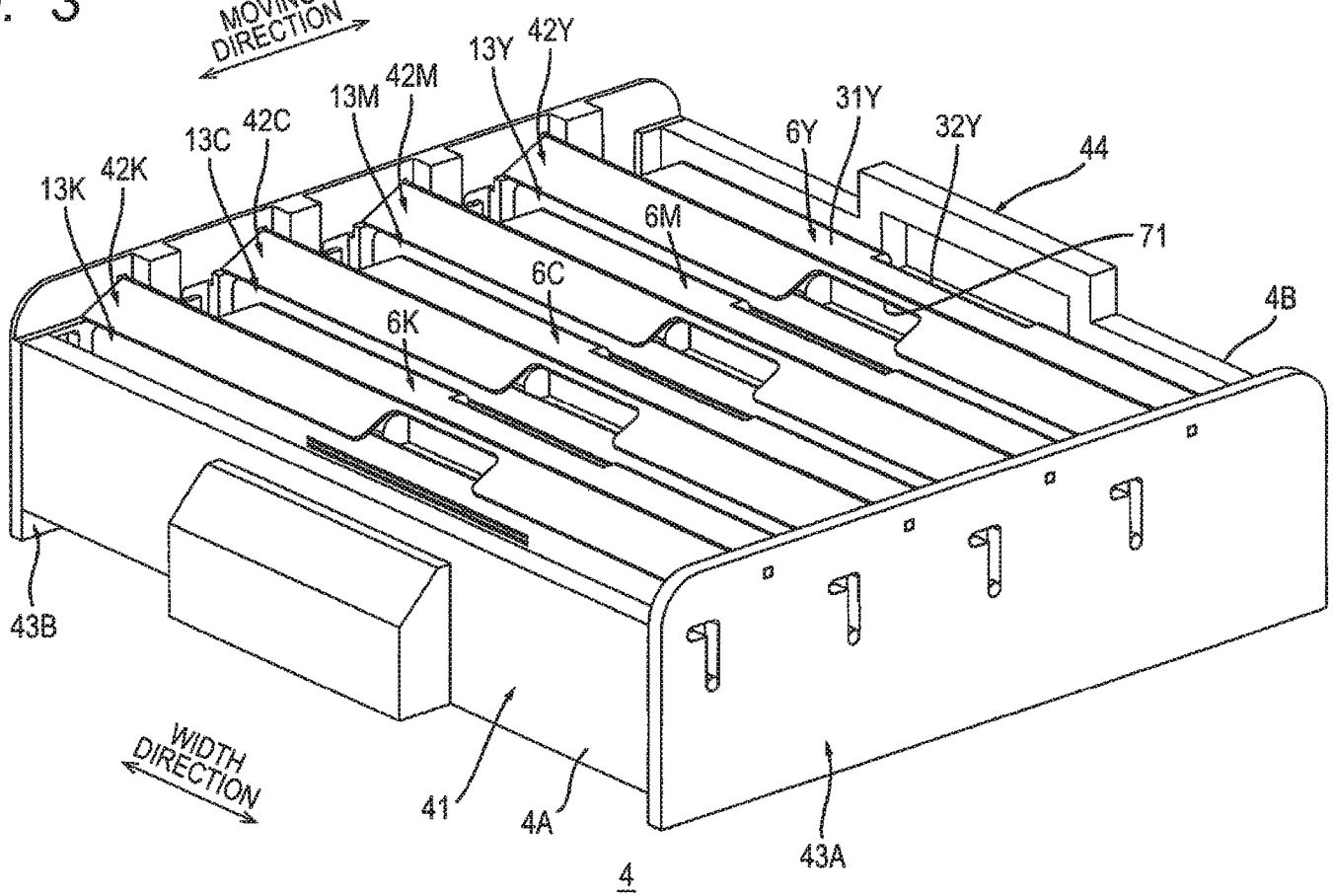
FIG. 3 is a perspective view of a drawer unit shown in FIG. 1.

As shown in FIG. 3, the drawer unit 4 includes a drawer frame 41 and a plurality of covers 42Y, 42M, 42C, 42K, in addition to the above-described plurality of exposure heads 13Y, 13M, 13C, 13K.

2.1 Drawer Frame

The plurality of drum cartridges 5Y, 5M, 5C, 5K and the plurality of developing cartridges 6Y, 6M, 6C, 6K are configured to be mounted onto the drawer frame 41. The drawer frame 41 includes a side plate 43A, a side plate 43B, and a drawer handle 44.

2.1.1 Side Plate 43A

Figure 4:
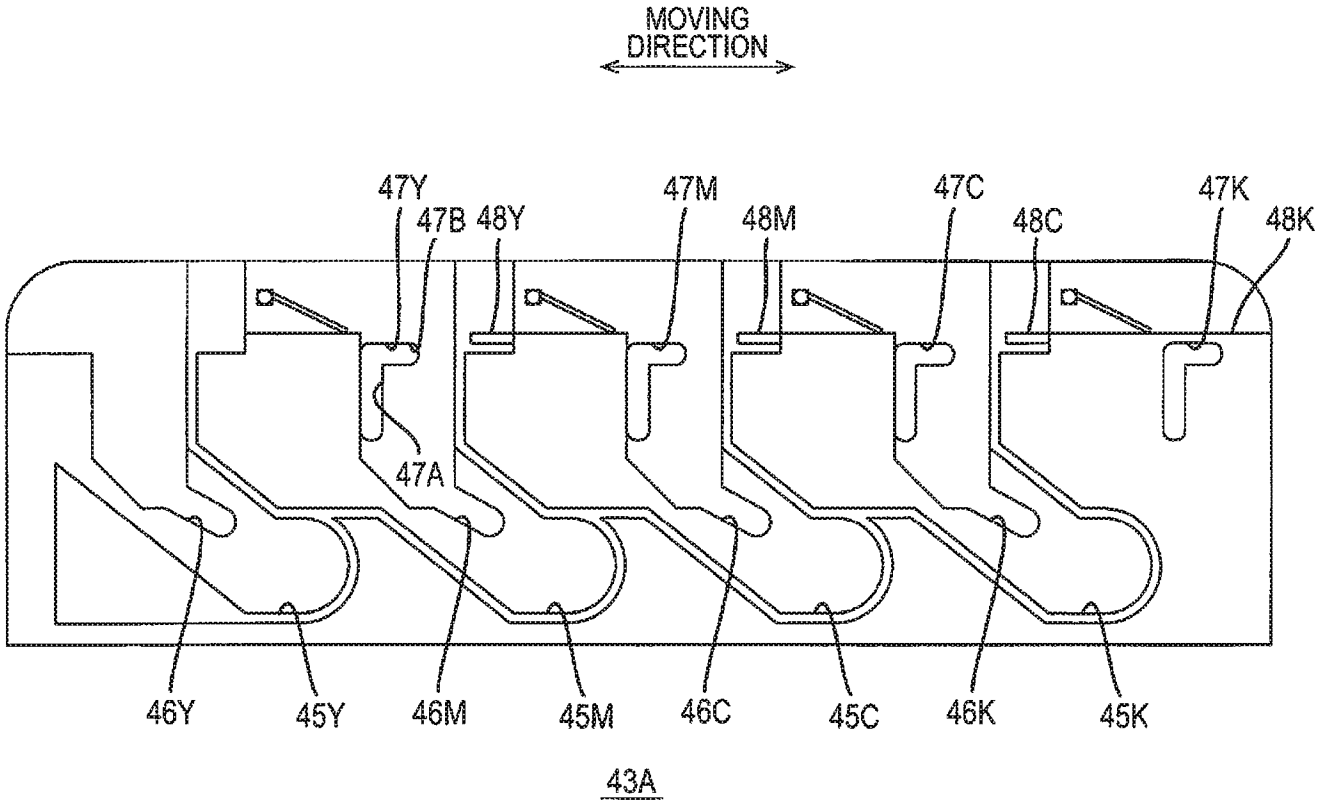
FIG. 4 is a side view of a side plate shown in FIG. 3.

The side plate 43A extends in the moving direction. The side plate 43A has a flat plate shape. As shown in FIG. 4, the side plate 43A includes a plurality of drum guides 45Y, 45M, 45C, 45K, a plurality of developing guides 46Y, 46M, 46C, 46K, a plurality of exposure head guides 47Y, 47M, 47C, 47K, and a plurality of protrusions 48Y, 48M, 48C, 48K.

The plurality of drum guides 45Y, 45M, 45C, 45K forms a row in the moving direction with intervals between the drum guides. The drum guide 45Y guides the drum cartridge 5Y when the drum cartridge 5Y is mounted. The drum guide 45Y is located at an opposite side from the exposure head guide 47M with respect to the exposure head guide 47Y in the moving direction. The drum guide 45M guides the drum cartridge 5M when the drum cartridge 5M is mounted. The drum guide 45C guides the drum cartridge 5C when the drum cartridge 5C is mounted. The drum guide 45K guides the drum cartridge 5K when the drum cartridge 5K is mounted. The drum guides 45M, 45C, 45K all have the same structure as the drum guide 45Y and are described in the same way as the drum guide 45Y. Therefore, a description of the drum guides 45M, 45C, 45K is omitted.

The plurality of developing guides 46Y, 46M, 46C, 46K forms a row in the moving direction with intervals between the developing guides. The developing guide 46Y guides the developing cartridge 6Y when the developing cartridge 6Y is mounted. The developing guide 46Y is located at the same side as the drum guide 45Y with respect to the exposure head guide 47Y in the moving direction. Specifically, the developing guide 46Y is located at an opposite side from the exposure head guide 47M with respect to the exposure head guide 47Y in the moving direction. The developing guide 46M guides the developing cartridge 6M when the developing cartridge 6M is mounted. The developing guide 46C guides the developing cartridge 6C when the developing cartridge 6C is mounted. The developing guide 46K guides the developing cartridge 6K when the developing cartridge 6K is mounted. The developing guides 46M, 46C, 46K all have the same structure as the developing guides 46Y and are described in the same way as the developing guide 46Y. Therefore, a description of the developing guides 46M, 46C, 46K is omitted.

The plurality of exposure head guides 47Y, 47M, 47C, 47K forms a row along the moving direction with intervals between the exposure heads. The exposure head guide 47Y guides movement of the exposure head 13Y. A boss 63A (see FIG. 5) of the exposure head 13Y is fitted into the exposure head guide 47Y. The boss 63A is described later. The exposure head guide 47Y includes a first portion 47A and a second portion 47B. The first portion 47A extends in the upper-lower direction. The second portion 47B extends from an upper edge of the first portion 47A. The second portion 47B extends in the moving direction. More specifically, the second portion 47B extends in a direction separating from the developing guide 46Y in the moving direction. In other words, the second portion 47B extends in the moving direction from the developing guide 46Y toward the exposure head guide 47M.

The plurality of protrusions 48Y, 48M, 48C, 48K forms a row along the moving direction with intervals between the protrusions. Each of the plurality of protrusions 48Y, 48M, 48C, 48K protrudes outward from the side plate 43A toward the side plate 43B. The protrusion 48Y contacts an arm 60A (see FIG. 5) of the exposure head 13Y when the exposure head 13Y is located at a third position to support the exposure head 13Y. The arm 60A is described later. Each of the protrusions 48M, 48C, 48K have the same structure as the protrusion 48Y and are described in the same way as the protrusion 48Y. Therefore, a description of the protrusions 48M, 48C, 48K is omitted.

2.1.2 Side Plate 43B

As shown in FIG. 3, the side plate 43B is located in a width direction with an interval from the side plate 43A. The width direction intersects with the moving direction and the upper-lower direction. The width direction is the same direction as the axial direction and the direction in which the developing roller 16Y extends in a state where the drum cartridge 5Y and the developing cartridge 6Y are mounted on the drawer frame 41. In a state where the plurality of drum cartridges 5Y, 5M, 5C, 5K and the plurality of developing cartridges 6Y, 6M, 6C, 6K are mounted on the drawer unit 4, the plurality of drum cartridges 5Y, 5M, 5C, 5K and the plurality of developing cartridges 6Y, 6M, 6C, 6K are located between the side plate 43A and the side plate 43B in the width direction. In other words, the side plate 43B is located at an opposite side from the side plate 43A with respect to the drum cartridge 5Y in the axial direction, in a state where the drum cartridge 5Y is mounted on the drawer unit 4. The plurality of exposure heads 13Y, 13M, 13C, 13K is also located between the side plate 43A and the side plate 43B in the width direction.

Note that the side plate 43B has the same structure as the side plate 43A and is described in the same way as the side plate 43A. Therefore, a description of the side plate 43B is omitted.

2.1.3 Drawer Handle

The drawer frame 41 includes a rear plate 4A and a front plate 4B. In a state where the drawer frame 41 is located at the internal position, the rear plate 4A is located at the side (the rear side) of the drawer frame 41 close to the fixing device 8, and the front plate 4B is located at the side (the front side) of the drawer frame 41 close to the cover 2B (or close to the opening 2A). In other words, the rear plate 4A is the upstream end of the drawer frame 41 in a direction in which the drawer unit 4 moves from the internal position to the external position. The front plate 4B is the downstream end of the drawer frame 41 in the direction in which the drawer unit 4 moves from the internal position to the external position. The drawer handle 44 is provided at the front plate 4B. The drawer handle 44 protrudes upward from the drawer frame 41. An upper edge of the drawer handle 44 is located at an upper position than the plurality of covers 42Y, 42M, 42C, 42K in a state where each of the plurality of covers 42Y, 42M, 42C, 42K is located at the first protection position. In other words, the plurality of covers 42Y, 42M, 42C, 42K is located at a lower position than the drawer handle 44 when the drawer unit 4 moves from the internal position to the external position. With this configuration, the attention of the user can be attracted to the drawer handle 44 when the drawer unit 4 has moved from the internal position to the external position.

2.2 Exposure Head

Figure 5:
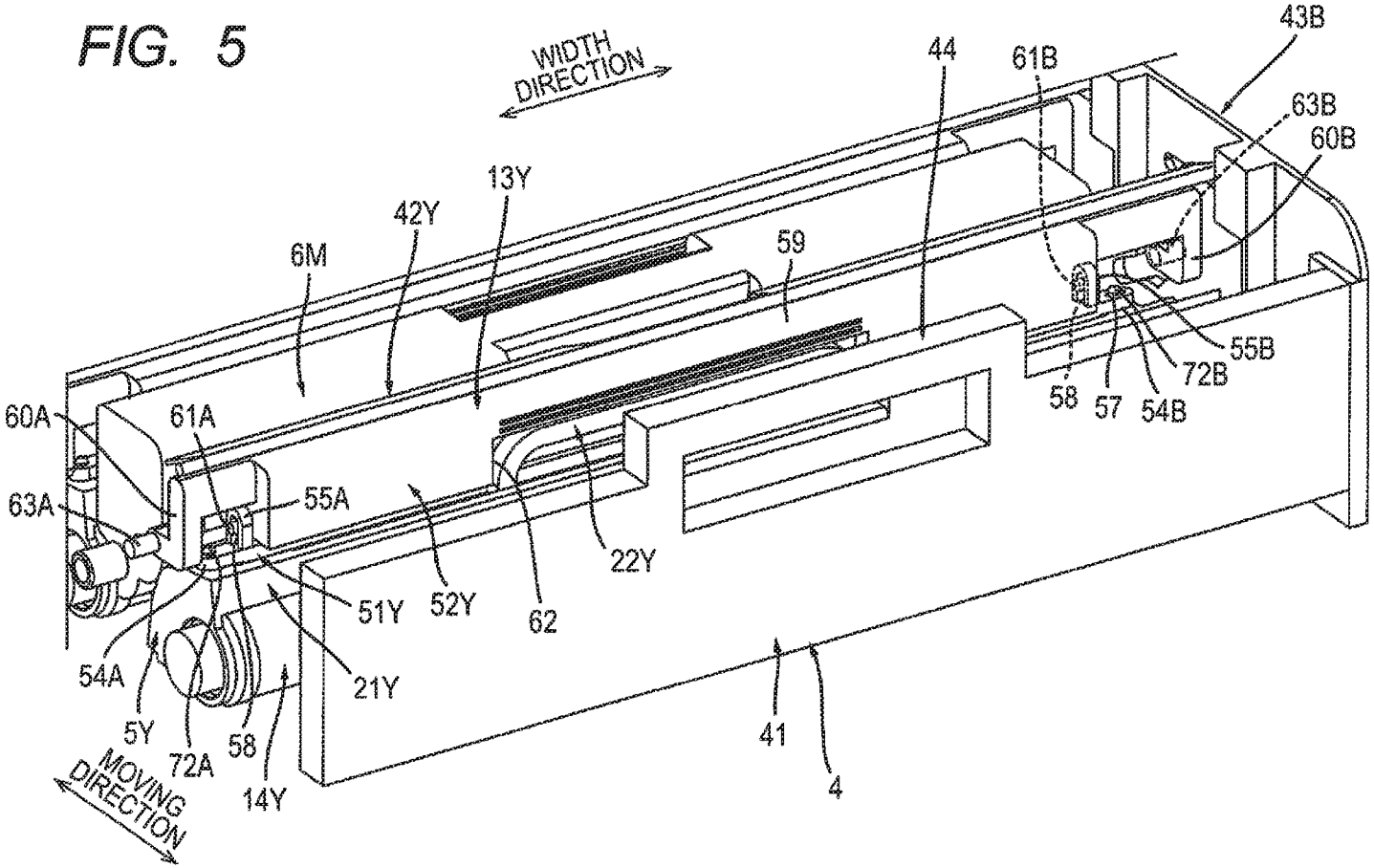
FIG. 5 is a perspective view for viewing the drawer unit shown in FIG. 3 from a different angle.

As shown in FIG. 5, the exposure head 13Y is supported by the drawer frame 41. The exposure head 13Y extends in the width direction of the drawer unit 4. The exposure head 13Y is configured to move from the first position (see FIG. 8) to the third position (see FIG. 10) through the second position (see FIG. 9) in a state where the drum cartridge 5Y is mounted on the drawer unit 4 at the external position.

The first position is a position at which the exposure head 13Y is adjacent to the photosensitive drum 14Y. The exposure head 13Y is configured to expose the photosensitive drum 14Y at the first position. The exposure head 13Y extends in the upper-lower direction at the first position. The exposure head 13Y is located between the developing cartridge 6Y and the developing cartridge 6M at the first position.

The second position is a position at which the exposure head 13Y has slidably moved from the first position. More specifically, the second position is a position at which the exposure head 13Y has slidably moved upward from the first position. The exposure head 13Y separates farther away from the photosensitive drum 14Y at the second position than at the first position.

The third position is a position at which the exposure head 13Y has rotatably moved from the second position. The exposure head 13Y is configured to move from the second position to the third position in a state where the developing cartridge 6Y has been removed from the drawer unit 4. The exposure head 13Y is located above the developing cartridge 6M at the third position. The exposure head 13Y separates farther away from the photosensitive drum 14Y at the third position than at the second position.

As shown in FIG. 5, the exposure head 13Y includes an LED array, a photosensitive frame 51Y, and a support frame 52Y.

2.2.1 LED Array

The LED array is accommodated within the drawer frame 51Y, and thus not shown in the drawings. Note that the LED array is located a particular distance from the photosensitive drum 14Y in a state where the drum cartridge 5Y is mounted on the drawer unit 4 and where the exposure head 13Y is located at the first position. The LED array includes a plurality of LEDs. The plurality of LEDs is arranged in the width direction of the drawer unit 4. In other words, the plurality of LED is arranged in the axial direction in a state where the drum cartridge 5Y is mounted on the drawer unit 4 and where the exposure head 13Y is located at the first position.

2.2.2 Exposure Frame

Figure 6A:
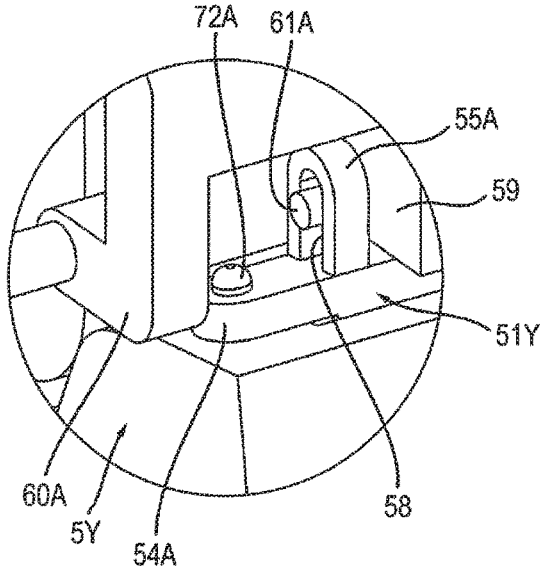
FIG. 6A illustrates a state in which an exposure head is located at a first position and the exposure head is engaged with a drum cartridge.
Figure 6B:
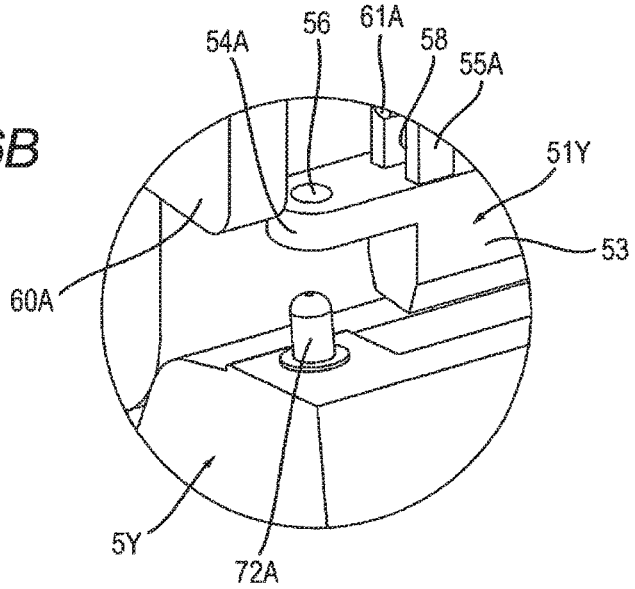
FIG. 6B illustrates a state in which the exposure head is located at a second position and the engagement between the exposure head and the drum cartridge is released.

The exposure frame 51Y supports the LED array. The exposure frame 51Y is located below the support frame 52Y in a state where the exposure head 13Y is located at the first position. The exposure frame 51Y is located between the support frame 52Y and the photosensitive drum 14Y (see FIG. 8) in the upper-lower direction in a state where the drum cartridge 5Y is mounted on the drawer unit 4 and where the exposure head 13Y is located at the first position. As shown in FIGS. 6A and 6B, the exposure frame 51Y includes a frame body 53, two protruding portions 54A and 54B (see FIG. 5), and two protruding portions 55A and 55B (see FIG. 5).

The frame body 53 extends in the width direction of the drawer unit 4. The frame body 53 has a tubular shape. The frame body 53 accommodates the LED array. With this configuration, the exposure frame 51Y supports the LED array.

The protruding portion 54A protrudes from one end of the frame body 53 in the width direction. The protruding portion 54A extends in the width direction. The protruding portion 54A has a hole 56. The hole 56 is circular. A boss 72A of the drum cartridge 5Y is fitted into the hole 56 in a state where the drum cartridge 5Y is mounted on the drawer unit 4 and where the exposure head 13Y is located at the first position. The boss 72A is described later. By fitting the boss 72A into the hole 56, the exposure frame 51Y is positioned with respect to the drum cartridge 5Y.

As shown in FIG. 5, the protruding portion 54B is located on an opposite side from the protruding portion 54A with respect to the frame body 53 (see FIG. 6B) in the width direction. The protruding portion 54B protrudes from another end of the frame body 53 in the width direction. The protruding portion 54B extends in the width direction. The protruding portion 54B has a hole 57. The hole 57 is an elongated hole that extends in the width direction. A boss 72B of the drum cartridge 5Y is fitted into the hole 57 in a state where the drum cartridge 5Y is mounted on the drawer unit 4 and where the exposure head 13Y is located at the first position. The boss 72B is described later. By fitting the boss 72A into the hole 56 and the boss 72B into the hole 57 when the exposure head 13Y is located at the first position, it becomes impossible to remove the drum cartridge 5Y from the drawer unit 4. In addition, by removing the boss 72A from the hole 56 and the boss 72B from the hole 57 when the exposure head 13Y is located at the third position, it becomes possible to remove the drum cartridge 5Y from the drawer unit 4.

As shown in FIG. 6A, the protruding portion 55A protrudes from an upper surface of the frame body 53. The protruding portion 55A extends in the upper-lower direction. The protruding portion 55A is located between the frame body 59 and the arm 60A of the support frame 52Y in the width direction. The protruding portion 55A has a hole 58. The hole 58 extends in the upper-lower direction. A boss 61A of the support frame 52Y is fitted into the hole 58.

As shown in FIG. 5, the protruding portion 55B is located between the frame body 59 and the arm 60B of the support frame 52Y in the width direction. The protruding portion 55B has the same structure as the protruding portion 55A and is described in the same way as the protruding portion 55A. Therefore, a description of the protruding portion 55B is omitted.

2.2.3 Support Frame

The support frame 52Y supports the exposure frame 51Y. The support frame 52Y includes the frame body 59 and the two arms 60A and 60B. The support frame 52Y also includes a concave portion 62. In other words, the exposure head 13Y includes the concave portion 62.

The frame body 59 extends in the width direction. The frame body 59 has two bosses 61A and 61B.

The boss 61A extends from one side surface of the frame body 59 in the width direction. The boss 61A extends in the width direction. The boss 61A has a columnar shape. The boss 61A is fitted into the hole 58 of the protruding portion 55A of the exposure frame 51Y.

The boss 61B is located on an opposite side from the boss 61A with respect to the frame body 59 in the width direction. The boss 61B extends from another side surface of the frame body 59 in the width direction. The boss 61B extends in the width direction. The boss 61B has a columnar shape. The boss 61B is fitted into the hole 58 of the protruding portion 55B of the exposure frame 51Y. By fitting the boss 61A into the hole 58 of the protruding portion 55A and the boss 61B into the hole 58 of the protruding portion 55B, the support frame 52Y supports the exposure frame 51Y.

The arm 60A extends from the one side surface of the frame body 59 in the width direction. The arm 60A is located at a position different from the boss 61A. The arm 60A includes the boss 63A. The boss 63A extends in the width direction. The boss 63A has a columnar shape. The boss 63A is fitted into the exposure head guide 47Y (see FIG. 4) of the side plate 43A.

The arm 60B extends from the other side surface of the frame body 59 in the width direction. The arm 60B is located at a position different from the boss 61B. The arm 60B includes a boss 63B. The boss 63B extends in the width direction. The boss 63B has a columnar shape. The boss 63B is fitted into the exposure head guide 47Y of the side plate 43B. By fitting the boss 63A into the exposure head guide 47Y of the side plate 43A and the boss 63B into the exposure head guide 47Y of the side plate 43B, the exposure head 13Y is supported by the drawer frame 41 so as to move along the exposure head guide 47Y.

Figure 7A:
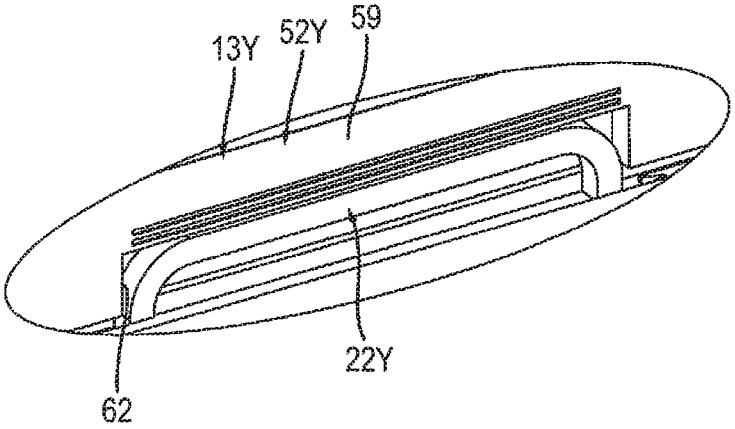
FIG. 7A illustrates a state in which the exposure head is located at the first position and a drum handle is housed in a recess of the exposure head.
Figure 7B:
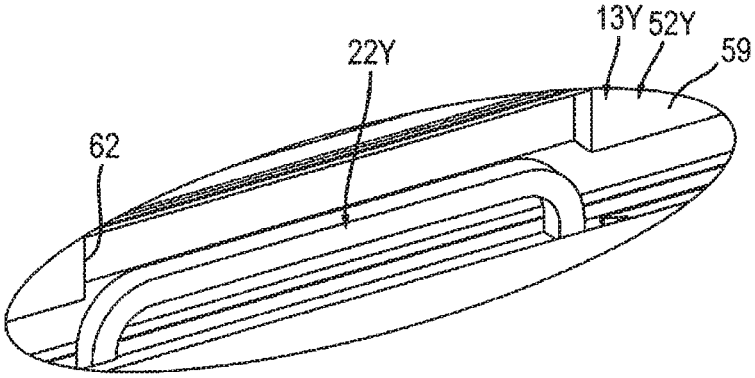
FIG. 7B illustrates a state in which the exposure head is located at the second position and the drum handle has been removed from the recess of the exposure head.

As shown in FIGS. 7A and 7B, the concave portion 62 is disposed in the frame body 59. The concave portion 62 is recessed upward from a lower edge of the frame body 59 in the width direction. As shown in FIG. 7A, the concave portion 62 accommodates a drum handle 22Y in a state where the drum cartridge 5Y is mounted on the drawer unit 4 and where the exposure head 13Y is located at the first position. The drum handle 22Y is described later. The user cannot grasp the drum handle 22Y when the drum handle 22Y is housed in the concave portion 62. Further, as shown in FIG. 7B, when the exposure head 13Y moves from the first position to the second position, the drum handle 22Y is removed from the concave portion 62. When the drum handle 22Y is removed from the concave portion 62, the user can grasp the drum handle 22Y.

2.3 Plurality of Covers

Figure 8:
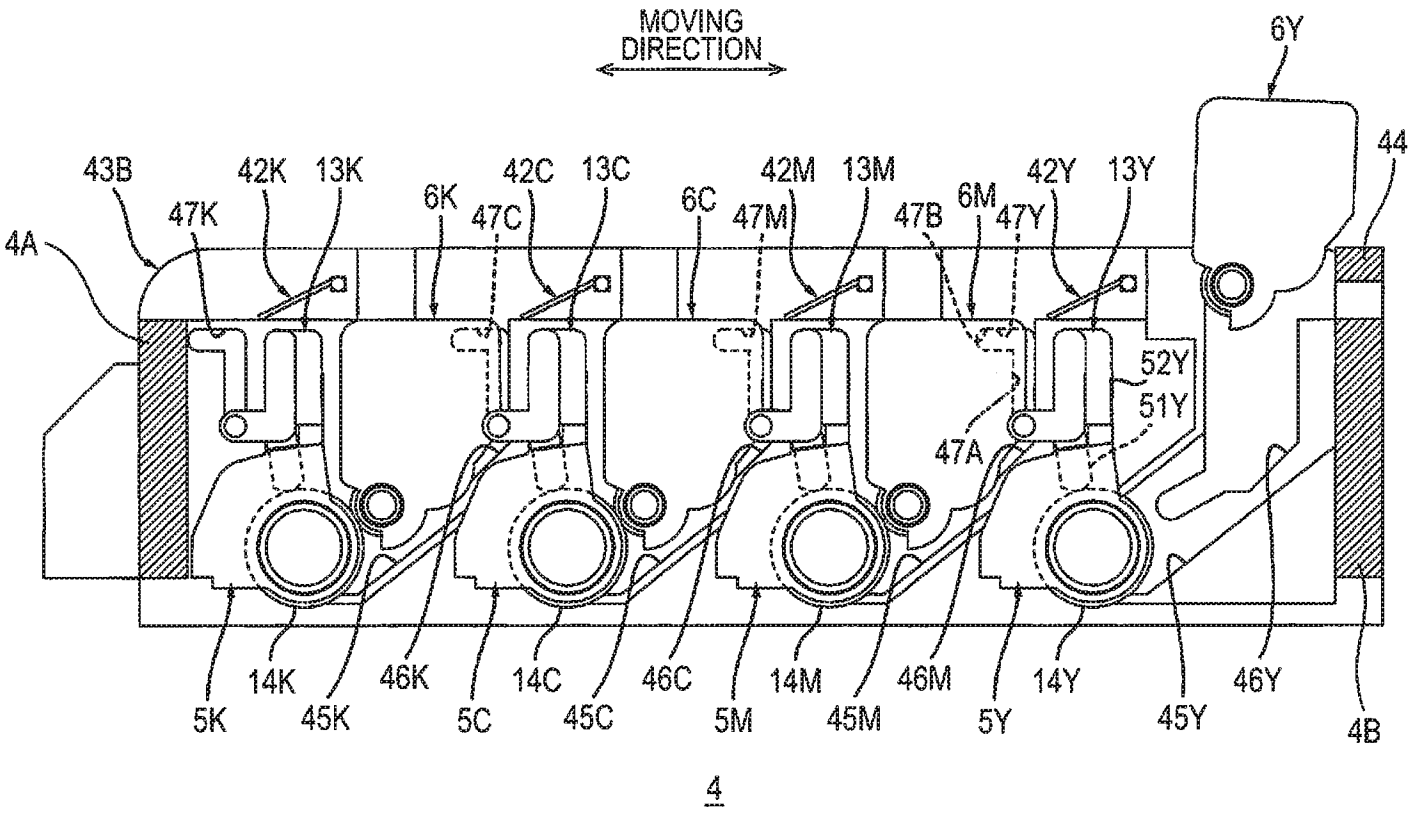
FIG. 8 is an explanatory diagram for illustrating mounting and removal of a developing cartridge with respect to the drum unit.

As shown in FIG. 8, the plurality of covers 42Y, 42M, 42C, 42K forms a row along the moving direction with intervals between the covers. The cover 42Y protects the exposure head 13Y. More specifically, the cover 42Y is configured to rotatably move between the first protection position (see FIG. 8) and a second protection position (see FIG. 10).

The first protection position is a position for protecting the exposure head 13Y located at the first position. In a state where the exposure head 13Y is located at the first position and where the cover 42Y is located at the first protection position, the cover 42Y is located above the exposure head 13Y. In a state where the exposure head 13Y is located at the first position and where the cover 42Y is located at the first protection position, the cover 42Y covers the exposure head 13Y as viewed from above. With this configuration, in a state where the cover 42Y is located at the first protection position, the cover 42Y protects the exposure head 13Y located at the first position.

The second protection position is a position for protecting the exposure head 13Y located at the third position. In a state where the exposure head 13Y is located at the third position and where the cover 42Y is located at the third protection position, the cover 42Y is located between the exposure head 13Y and an upper end of the drum guide 45Y in the moving direction. In other words, in a state where the exposure head 13Y is located at the third position and where the cover 42Y is located at the third protection position, the drum cartridge 5Y can be mounted onto the drawer unit 4 through an opposite side from the exposure head 13Y with respect to the cover 42Y. Because the cover 42Y is located between the exposure head 13Y and the upper end of the drum guide 45Y when the cover 42Y is located at the second protection position, the cover 42Y protects the exposure head 13Y located at the third position. The cover 42Y covers the LED array in a state where the exposure head 13Y is located at the third position. Because the cover 42Y covers the LED array, in a state where the drawer unit 4 is located at the external position and where the exposure head 13Y is located at the third position, the LED array of the exposure head 13Y can be protected.

Figure 9:
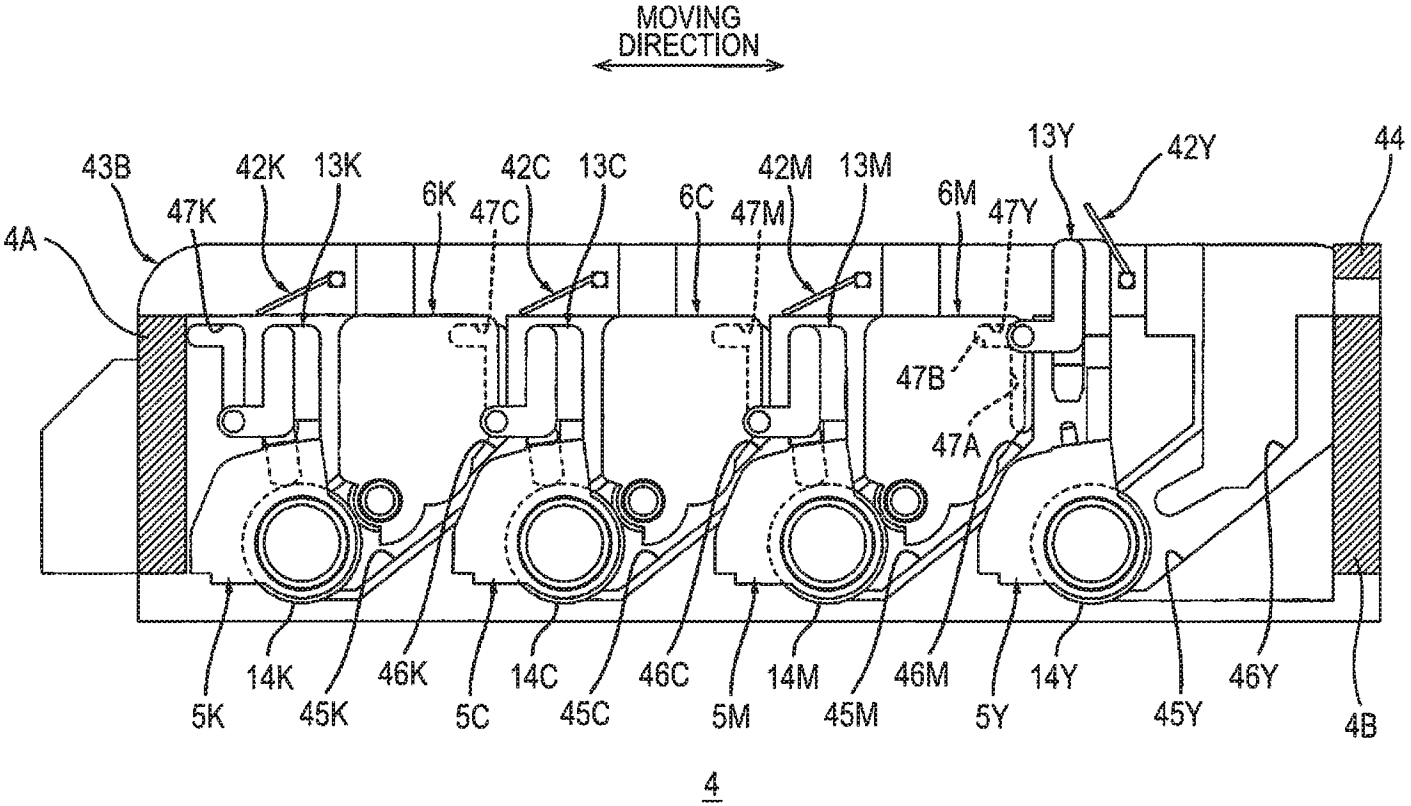
FIG. 9 is an explanatory diagram for explaining movement of the exposure head and illustrates a case in which the exposure head is located at the second position and a cover is rotatably moved from a first protection position in a first rotation direction.
Figure 10:
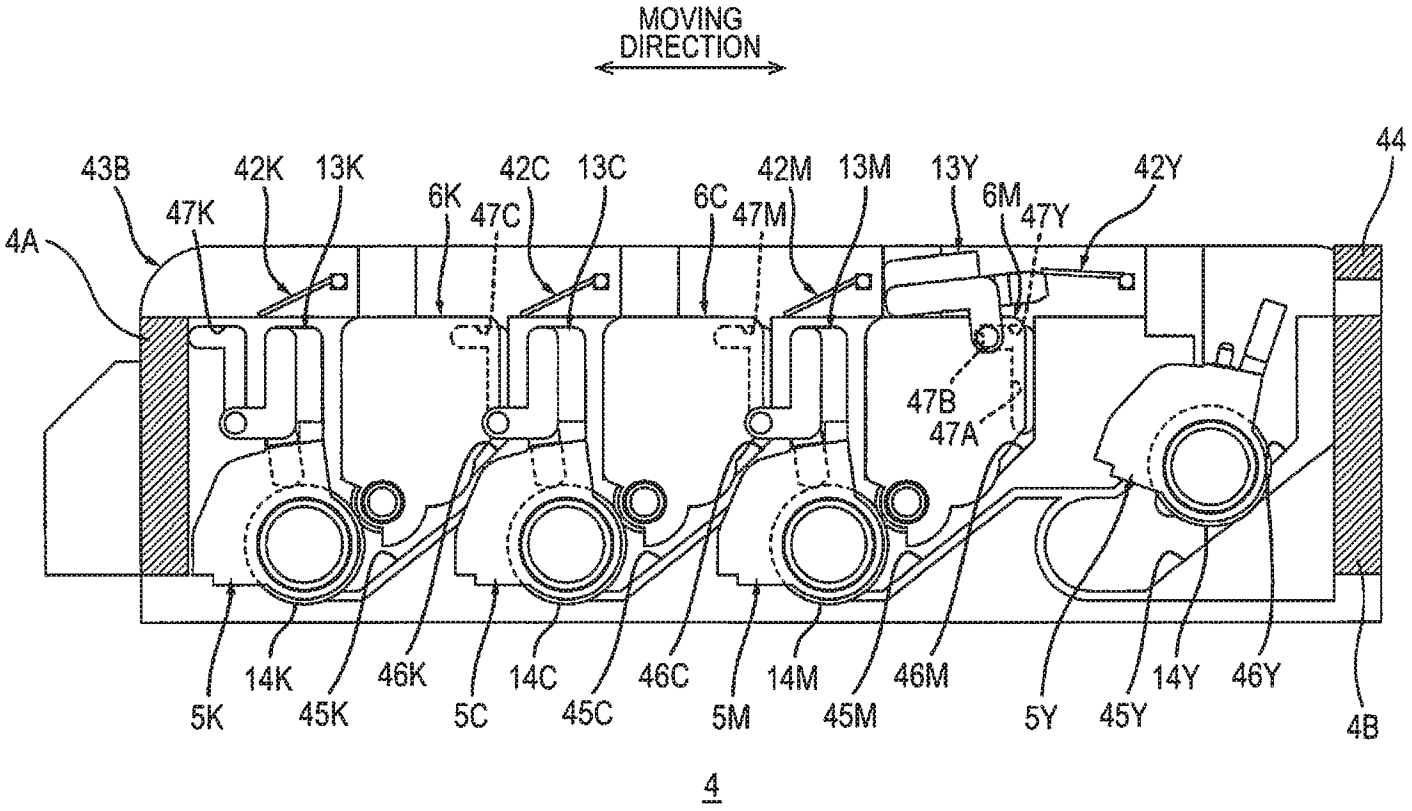
FIG. 10 is an explanatory diagram continuing on from FIG. 9 for illustrating movement of the exposure head and illustrates a case in which the exposure head is located at a third position and the cover is located at a second protection position.

As shown in FIGS. 8 to 10, the cover 42Y moves from the first protection position to the second protection position by contacting the exposure head 13Y when the exposure head 13Y moves from the first position to the third position. In other words, the cover 42Y moves from the first protection position to the second protection position by moving in conjunction with the exposure head 13Y when the exposure head 13Y moves from the first position to the third position. More specifically, as shown in FIGS. 8 and 9, the cover 42Y contacts the exposure head 13Y when the exposure head 13Y moves from the first position to the second position, thereby rotatably moving from the first protection position in a first rotation direction. Then, the cover 42Y rotatably moves in a second rotation direction opposite from the first rotation direction while contacting the exposure head 13Y when the exposure head 13Y moves from the second position to the third position.

Note that, when the cover 42Y rotatably moves in the first rotation direction, the cover 42Y may contact a part of the side plate 43A and be stopped from rotatably moving in the first rotation direction at a particular position. Then, the cover 42Y rotatably moves using its own weight in the second rotation direction and moves to the second protection position. In addition, the cover 42Y may be pressed toward the second rotation direction by a spring (not shown), not by its own weight.

As shown in FIG. 3, the cover 42Y extends in the width direction. The cover 42Y has a flat plate shape. The cover 42Y extends from the side plate 43A to the side plate 43B. One end of the cover 42Y in the width direction is supported by the side plate 43A. Another end of the cover 42Y in the width direction is supported by the side plate 43B. The cover 42Y has a cutout 71.

The cutout 71 exposes an upper end of the exposure head 13Y in a state where the exposure head 13Y is located at the first position and where the cover 42Y is located at the first protection position. With this configuration, the user can grasp the upper end of the exposure head 13Y through the cutout 71 in a state where the exposure head 13Y is located at the first position and where the cover 42Y is located at the first protection position. In addition, by grasping the upper end of the exposure head 13Y without touching the cover 42Y, the user can move the exposure head 13Y from the first position to the third position, thereby moving the cover 42Y from the first protection position to the second protection position. Therefore, there is no need for the user to separately move the cover 42Y and the exposure head 13Y.

Each of the covers 42M, 42C, 42K has the same structure as the cover 42Y and is described in the same way as the cover 42Y. Therefore, a description of the covers 42M, 42C, 42K is omitted.

3. Details of Drum Cartridge

As shown in FIG. 5, the drum cartridge 5Y includes a drum frame 21Y and a drum handle 22Y in addition to the above-described photosensitive drum 14Y and charger 15Y (see FIG. 1).

The drum frame 21Y supports the photosensitive drum 14Y and the charger 15Y. The drum frame 21Y covers the photosensitive drum 14Y and the charger 15Y. The drum frame 21Y extends in the axial direction. The drum frame 21Y has two bosses 72A and 72B. The boss 72A extends from a top surface of the drum frame 21Y. The boss 72A extends in the upper-lower direction. The boss 72A has a columnar shape. The boss 72B is located with an interval from the boss 72A in the axial direction. The boss 72B has the same shape as the boss 72A.

The drum handle 22Y is grasped by the user when the user mounts the drum cartridge 5Y onto the drawer unit 4. The drum handle 22Y is provided on the drum frame 21Y. The drum handle 22Y protrudes upward from the top surface of the drum frame 21Y. The drum handle 22Y extends in the axial direction. The drum handle 22Y is located between the boss 72A and the boss 72B in the axial direction. The drum handle 22Y is covered by the support frame 52Y of the exposure head 13Y and the developing cartridge 6Y in a state where the drum cartridge 5Y and the developing cartridge 6Y are mounted on the drawer unit 4 and where the exposure head 13Y is located at the first position. With this configuration, the user cannot see the drum handle 22Y in a state where the drum cartridge 5Y and the developing cartridge 6Y are mounted on the drawer unit 4 and where the exposure head 13Y is located at the first position.

4. Details of Developing Cartridge

As shown in FIG. 3, the developing cartridge 6Y includes a developing casing 31Y and a developing handle 32Y.

The developing casing 31Y is configured to store the toner. The developing casing 31Y extends in the width direction. The developing casing 31Y has a tubular shape.

The developing handle 32Y is grasped by the user when the user mounts the developing cartridge 6Y onto the drawer unit 4. The developing handle 32Y is provided on a top surface of the developing casing 31Y. The developing handle 32Y is not covered in a state where the drum cartridge 5Y and the developing cartridge 6Y are mounted on the drawer unit 4 and where the exposure head 13Y is located at the first position. With this configuration, the user can see the developing handle 32Y in a state where the drum cartridge 5Y and the developing cartridge 6Y are mounted on the drawer unit 4 and where the exposure head 13Y is located at the first position. In other words, the user can see the developing handle 32Y without seeing the drum handle 22Y, in a state where the drum cartridge 5Y and the developing cartridge 6Y are mounted on the drawer unit 4 and where the exposure head 13Y is located at the first position. Therefore, the user does not try to remove the drum cartridge 5Y before removing the developing cartridge 6Y from the drawer unit 4 and can recognize that the developing cartridge 6Y is to be removed from the drawer unit 4 first.

5. Removing Drum Cartridge from Drawer Unit

The operation of removing the drum cartridge 5Y from the drawer unit 4 is described below with reference to FIGS. 8 to 10.

In order to remove the drum cartridge 5Y from the drawer unit 4, first, as shown in FIG. 8, a user pulls the developing cartridge 6Y out from the drawer unit 4.

Then, the developing cartridge 6Y is guided by the developing guide 46Y to pass through the opposite side from the developing cartridge 6M with respect to the exposure head 13Y and be removed from the drawer unit 4.

Next, as shown in FIG. 9, the user pulls up the exposure head 13Y from the first position.

Then, the exposure head 13Y is guided by the first portion 47A of the exposure head guide 47Y and moves from the first position to the second position.

In addition, the cover 42Y is pushed up by the exposure head 13Y and rotatably moves from the first protection position in the first rotation direction.

Then, as shown in FIG. 10, the user pushes the exposure head 13Y toward the top of the developing cartridge 6M.

Then, the exposure head 13Y is guided by the second portion 47B of the exposure head guide 47Y to move in the moving direction and rotatably move about the bosses 63A and 63B.

Then, the arm 60A contacts the protrusion 48Y (see FIG. 4) of the side plate 43A, and thereby the exposure head 13Y is located at the third position.

In addition, when the exposure head 13Y rotatably moves from the second position to the third position, the cover 42Y rotatably moves in the second rotation direction to be located at the second protection position.

Here, when the exposure head 13Y moves from the first position to the second position, as shown in FIG. 6B, the boss 72A of the drum cartridge 5Y is removed from the hole 56 of the exposure head 13Y and the boss 72B of the drum cartridge 5Y is removed from the hole 57 of the exposure head 13Y. Therefore, the drum cartridge 5Y can be removed from the drawer unit 4 in a state where the exposure head 13Y is located at the third position.

As shown in FIG. 10, the user pulls out the drum cartridge 5Y from the drawer unit 4.

Then, the drum cartridge 5Y is guided by the drum guide 45Y to be removed from the drawer unit 4 through an opposite side from the exposure head 13Y with respect to the cover 42Y.

With this configuration, the operation of removing the drum cartridge 5Y from the drawer unit 4 is finished.

6. Mounting Drum Cartridge onto Drawer Unit

The operation of mounting the drum cartridge 5Y onto the drawer unit 4 is described below with reference to FIGS. 8 to 10.

In order to mount the drum cartridge 5Y onto the drawer unit 4, as shown in FIG. 10, in a state where the developing cartridge 6Y is removed from the drawer unit 4 and where the exposure head 13Y is located at the third position, the user fits the drum cartridge 5Y into the drum guide 45Y to insert the drum cartridge 5Y into the drawer unit 4.

Then, the drum cartridge 5Y is guided by the drum guide 45Y to be mounted onto the drawer unit 4 through an opposite side from the exposure head 13Y with respect to the cover 42Y.

Then, as shown in FIGS. 10 to 8, the user moves the exposure head 13Y from the third position (see FIG. 10) through the second position (see FIG. 9) to the first position (see FIG. 8).

Then, as shown in FIG. 6A, when the exposure head 13Y moves from the second position to the first position, the boss 72A of the drum cartridge 5Y is fitted into the hole 56 of the exposure head 13Y and the boss 72B of the drum cartridge 5Y is fitted into the hole 57 of the exposure head 13Y. In this state, it is impossible to remove the drum cartridge 5Y from the drawer unit 4.

Next, as shown in FIG. 8, the user fits the developing cartridge 6Y into the developing guide 46Y to insert the developing cartridge 6Y into the drawer unit 4.

Then, the developing cartridge 6Y is guided by the developing guide 46Y to be mounted onto the drawer unit 4 from an opposite side from the developing cartridge 6M with respect to the exposure head 13Y.

7. Operations and Effects

As shown in FIGS. 8 and 9, according to the image forming apparatus 1, the exposure head 13Y is reliably separated from the photosensitive drum 14Y by slidably moving the exposure head 13Y from the first position to the second position.

In addition, as shown in FIGS. 9 and 10, by rotatably moving the exposure head 13Y from the second position to the third position, the amount of space needed to dispose the exposure head 13Y is reduced compared to disposing the exposure head 13Y at the second position. Further, if the user releases the arm 60A in a state where the exposure head 13Y is located at the second position, the exposure head 13Y returns (drops) to the first position due to its own weight. Thus, in the embodiment, the third position is provided at which the exposure head 13Y does not return to the first position even if the user releases the arm 60A.

As a result, an increase in size of the drawer unit 4 is minimized and the drum cartridge 5Y is prevented from contacting the exposure head 13Y when the drum cartridge 5Y is removed from the drawer unit 4.

8. Modification

While the disclosure has been described in detail with reference to the above aspects thereof, it would be apparent to those skilled in the art that various changes and modifications may be made therein without departing from the scope of the claims.

What is claimed is:

1. An image forming apparatus comprising:

a main housing;

a first drum cartridge including a first photosensitive drum; and a drawer unit configured such that the first drum cartridge is mounted thereon, the drawer unit being configured to move in a moving direction between an internal position at which the drawer unit is located inside the main housing and an external position at which the drawer unit is located outside the main housing, the drawer unit including:

a drawer frame; and an exposure head supported by the drawer frame and configured to expose the first photosensitive drum, in a state where the first drum cartridge is mounted on the drawer unit located at the external position, the exposure head being configured to move from a first position through a second position to a third position, the first position being a position at which the exposure head is adjacent to the first photosensitive drum and the first drum cartridge is prevented from being removed from the drawer unit, the second position being a position at which the exposure head is farther away from the first photosensitive drum than at the first position and the exposure head is slidably moved from the first position, and the third position being a position at which the exposure head is farther away from the first photosensitive drum than at the second position, the exposure head is rotatably moved from the second position, and the first drum cartridge is allowed to be removed from the drawer unit.

2. The image forming apparatus according to claim 1, further comprising:

a first developing cartridge configured to store toner supplied to the first photosensitive drum and configured to be mounted on the drawer unit, wherein the exposure head is allowed to move from the second position to the third position in a state where the first developing cartridge is removed from the drawer unit.

3. The image forming apparatus according to claim 2, further comprising:

a second drum cartridge including a second photosensitive drum and configured to be mounted on the drawer unit; and a second developing cartridge configured to store toner supplied to the second photosensitive drum and configured to be mounted on the drawer unit, wherein the exposure head is located between the first developing cartridge and the second developing cartridge in a state where the exposure head is located at the first position; and wherein the exposure head is located above the second developing cartridge in a state where the exposure head is located at the third position.

4. The image forming apparatus according to claim 1, wherein the exposure head includes an LED array and an exposure frame supporting the LED array; and wherein the drawer unit includes a cover configured to cover the LED array in a state where the exposure head is located at the third position.

5. The image forming apparatus according to claim 4, wherein, in a state where the exposure head is located at the third position, the first drum cartridge is configured to be mounted onto the drawer unit by passing through an opposite side from the exposure head with respect to the cover.

6. The image forming apparatus according to claim 4, wherein the main housing is formed with an opening through which the drawer unit moves between the internal position and the external position;

wherein the drawer frame includes:

a front plate located at a side of the drawer frame close to the opening in a state where the drawer unit is located at the internal position;

a rear plate located at an opposite side from the front plate;

a first side plate extending in the moving direction; and a second side plate extending in the moving direction, the second side plate being located at an opposite side from the first side plate with respect to the first drum cartridge in an axial direction in which a rotational axis of the first photosensitive drum extends in a state where the first drum cartridge is mounted on the drawer unit; and wherein the cover extends from the first side plate to the second side plate.

7. The image forming apparatus according to claim 4, wherein the cover has a cutout that exposes an upper end of the exposure head in a state where the exposure head is located at the first position.

8. The image forming apparatus according to claim 4, wherein the main housing is formed with an opening through which the drawer unit moves between the internal position and the external position;

wherein the drawer frame includes:

a front plate located at a side of the opening in a state where the drawer unit is located at the internal position; and a rear plate located at an opposite side from the front plate;

wherein the drawer frame includes a drawer handle provided at the front plate; and wherein the cover is located at a lower position than the drawer handle when the drawer unit moves from the internal position to the external position.

9. The image forming apparatus according to claim 4, wherein the cover is configured to rotatably move between:

a first protection position at which the cover protects the exposure head located at the first position; and a second protection position at which the cover protects the exposure head located at the third position; and wherein, when the exposure head moves from the first position to the third position, the cover is configured to move from the first protection position to the second protection position by contacting the exposure head.

10. The image forming apparatus according to claim 4, wherein the cover is configured to rotatably move between:

a first protection position at which the cover protects the exposure head located at the first position; and a second protection position at which the cover protects the exposure head located at the third position; and wherein, when the exposure head moves from the first position to the third position, the cover is configured to move from the first protection position to the second protection position in conjunction with movement of the exposure head.

11. The image forming apparatus according to claim 1, further comprising:

a first developing cartridge configured to store toner supplied to the first photosensitive drum and configured to be mounted on the drawer unit, wherein the first developing cartridge includes a developing handle;

wherein the first drum cartridge includes a drum handle; and wherein the exposure head is formed with a concave portion that accommodates the drum handle in a state where the first drum cartridge is mounted on the drawer unit.

12. The image forming apparatus according to claim 1, wherein the exposure head includes a boss extending in an axial direction in which a rotational axis of the first photosensitive drum extends in a state where the first drum cartridge is mounted on the drawer unit;

wherein the drawer frame includes a side plate formed with an exposure head guide, the boss being fitted into the exposure head guide, the exposure head guide including:

a first portion extending in an upper-lower direction; and a second portion extending from an upper edge of the first portion in the moving direction;

wherein the exposure head is guided by the first portion of the exposure head guide and moves from the first position to the second position; and wherein the exposure head is guided by the second portion of the exposure head guide to move in the moving direction and rotatably move about the boss, so that the exposure head is located at the third position.

* * * * *